US005119746A

United States Patent [19]

Nishikawa et al.

[11] Patent Number: 5,119,746

[45] Date of Patent: Jun. 9, 1992

[54] SEWING METHOD AND APPARATUS FOR OVEREDGE SEWING

[75] Inventors: Masahiko Nishikawa, Suita; Takeshi Orita, Itami; Shuji Nakashima, Osaka, all of Japan

[73] Assignee: Pegasus Sewing Machine Mfg., Co., Ltd., Osaka, Japan

[21] Appl. No.: 700,868

[22] Filed: May 16, 1991

[30] Foreign Application Priority Data

Jul. 27, 1990 [JP] Japan ..... 2-200090

[51] Int. Cl.[5] ..... D05B 25/00; D05B 35/10; D05B 37/04; D05B 1/20

[52] U.S. Cl. ..... 112/155; 112/150; 112/153; 112/162; 112/122; 112/308

[58] Field of Search ..... 112/155, 150, 153, 162, 112/262.3, 121.11, 308, 136, 309, 288, 122

[56] References Cited

U.S. PATENT DOCUMENTS

| | | | |
|---|---|---|---|
| 3,808,993 | 5/1974 | Heiler et al. | 112/155 |
| 3,889,614 | 6/1975 | Nicolay et al. | 112/153 |
| 4,307,675 | 12/1981 | Off et al. | 112/153 X |
| 4,423,690 | 1/1984 | Willenbacher et al. | 112/153 X |

FOREIGN PATENT DOCUMENTS 0268590 10/1989 Japan .

OTHER PUBLICATIONS

Rimoldi, "Automatic Unit for Serging Trousers", Mar., 1972.

*Primary Examiner*—Peter Nerbun
*Attorney, Agent, or Firm*—Jones, Tullar & Cooper

[57] ABSTRACT

A sewing method and apparatus is disclosed for preventing raveling of a cut cloth edge in the making of garments such as slacks and skirts. A pair of sewing machines symmetrically arranged with respect to a cloth feeding line are disposed oppositely to each other. Each sewing machine has an auxiliary guide for contacting the upper surface of a cloth, a cloth edge guide and a cloth stopper. Opposite edges of the cloth are simultaneously and automatically guided along respective sewing lines by the guides and serged by the sewing machines without failure. In operating the pair of sewing machines, another additional sewing machine can be operated to serge other edges of the next cloth.

5 Claims, 8 Drawing Sheets

FIG. 5
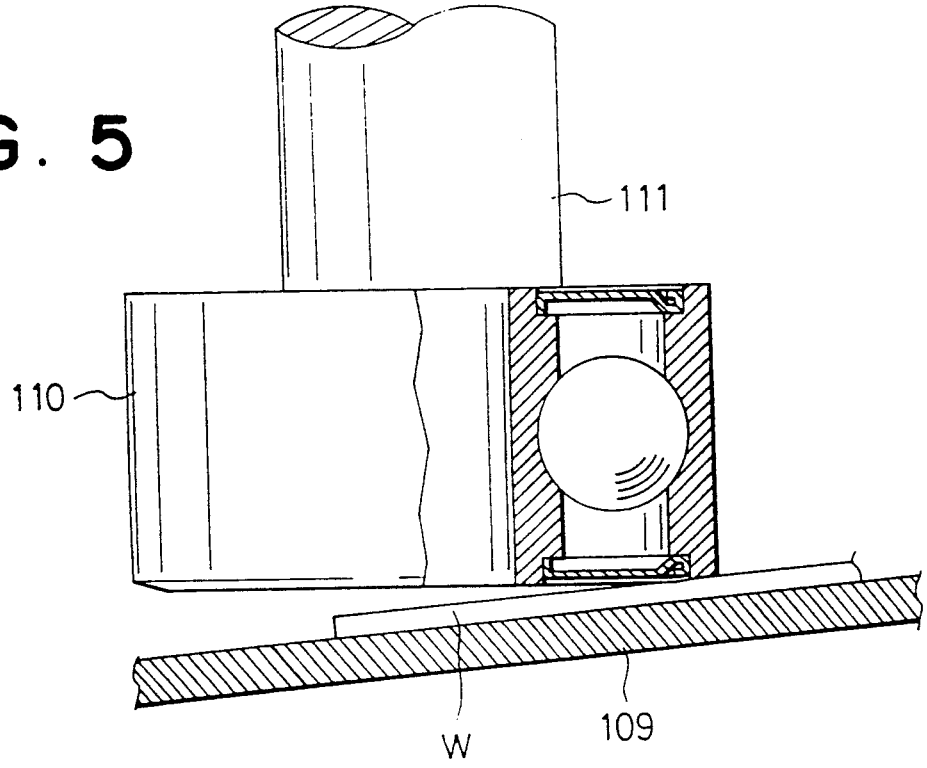
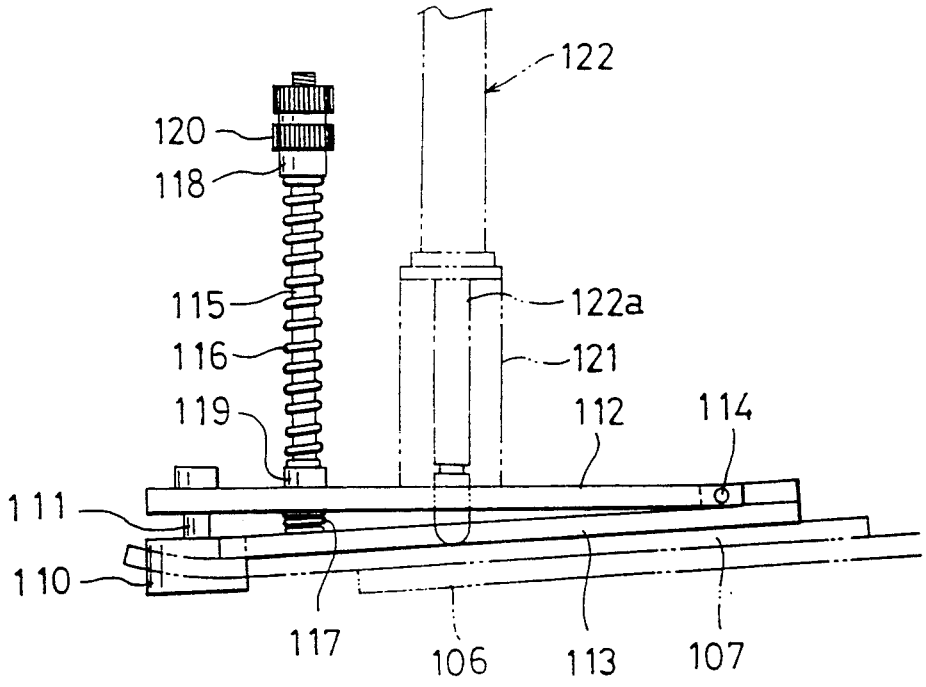
FIG. 6

SEWING METHOD AND APPARATUS FOR OVEREDGE SEWING

BACKGROUND OF THE INVENTION

1. Field of the Invention

The present invention relates to a sewing method and apparatus for overedge sewing the edge of a cloth to prevent raveling of the cloth edge cut in a desired shape for, say, slacks and skirts.

For such overedge sewing of a cloth edge, usually, an automatic serging machine is used. Generally, the automatic serging machine is equipped with a cloth guide plate, and a spacer disposed beneath the cloth guide plate, with a thickness corresponding to the cloth thickness. The cloth guide plate and spacer serve as a fitting guide of the cloth edge on a table before a presser foot of the serging machine. When the front end of the cloth fed from the operator's side on the table is detected by a sensor, the serging machine is started, and overedge sewing is done continuously and automatically until the rear end of the cloth is reached, while the cloth edge is guided under the presser foot by the cloth guide plate and the spacer.

2. Description of the Prior Art

Such automatic serging machines were hitherto disclosed in Japanese Utility Model Publication Sho. 56-46703, Japanese Patent Publication Sho. 60-43989, Sho. 57-1276, and Japanese Laid-open Patent Hei.1-268590, among others. The automatic serging machines disclosed in these publications are commonly designed to turn the cloth around the auxiliary presser until it abuts against a fitting guide for the edge guide before a needle drop point in order to guide and stitch a curved edge of the cloth.

In the conventional automatic serging machines, however, when a cut line of the curved edge is an out-curve, that is, curved outward of the machine, the curved edge can be securely sent into the needle drop point by a turning motion of the cloth, but when the cut line is an in-curve, the curved edge cannot be sent to the needle drop point unless the cloth is manually handled by the operator. That is, when serging the cloth having such an in-curved edge, the operator has to watch the cloth from start to end, which is one of the factors contributing to poor working efficiency.

Furthermore, in the conventional automatic serging machines, since the edge must be sewn on every side in order, the time loss is significant when it is necessary to watch the sewing of each cloth from start to end as mentioned above.

SUMMARY OF THE INVENTION

The invention is devised in response to such situations, and it is the primary object thereof to provide a sewing method and apparatus capable of enhancing working efficiency and quality, by automating overedge sewing even if the cut line of the cloth edge is an in-curve, and simultaneously sewing opposite edges of one cloth.

It is other object of the invention to provide a sewing method and apparatus capable of serging a edge of another cloth while automatically serging opposite edges of the cloth, thereby enhancing job efficiency.

The sewing apparatus of the invention which achieves the primary object comprises a pair of sewing machines disposed oppositely to the needle drop points and symmetrically on right and left sides, in which each sewing machine comprises:

an auxiliary guide for contacting the upper surface of the cloth before the needle drop point and outside of the sewing line, a guide member for guiding the edge of a cloth at the side of the auxiliary guide and inside of the sewing line, and a cloth stopper being disposed behind the needle drop point to lower and press down the cloth when receiving a specific signal.

According to such a sewing apparatus of the invention, in each sewing machine in which the needle drop points are opposing, as the edge of the cloth pressed down by the auxiliary guide is turned to fit against the guide side, even if the space of the opposite edges is widened by an out-curve or the like, it is possible to sew simultaneously along the two opposing edges.

Or if there is an in-curve in the edge to be sewn by one sewing machine, by lowering the cloth stopper of the other sewing machine by a specific signal, forwarding of the edge of the side pressed by this cloth stopper is inhibited, while the cloth is rotated about the position of being held down by the lowered cloth stopper, so that the edge of the cloth sewn by the other sewing machine is sewn along the in-curve.

Therefore, by simultaneous sewing of the opposite edges of one cloth, the sewing time is shortened and job efficiency may be enhanced. What is more, whether the curve of the opposite edges is an out-curve or an in-curve, serging of both edges may be done automatically without any manual handling by the operator, and hence the work load of the operator is lessened, and products of uniform quality may be always obtained regardless of the skill of the operator.

The sewing apparatus of the invention is characteristic in that a specific signal is generated after the rear end of the sewing edge has passed through the needle drop point.

According to the sewing apparatus of the invention in the case that an in-curve is formed at the rear end of either one side of the edges sewn simultaneously by a pair of sewing machines, the cloth may be rotated about the rear end of the other edge.

Of the opposing side edges, therefore, if there is an in-curve formed at the rear end of one side edge, for example, in the case of an in-curve of a cloth for use in slacks, the starting timing of hem stitching may be appropriately controlled.

In the sewing apparatus of the invention, the auxiliary guide elastically presses down the cloth.

According to the sewing machine of the invention, the running speed of the cloth portion contacting the auxiliary guide may be adjusted by the elastic force, and therefore the cloth edge may be fitted to the guide member with a proper force to favorably sew without missing the stitching line.

When the stopper presses one side of the cloth on a terminal end thereof, the advance of the cloth is stopped and a chaining thread formed continuously to the end is cut in a definite length.

The sewing apparatus of the invention relating to the other object mentioned above, is one in which a third sewing machine comprising the third auxiliary guide and guide member is disposed before the pair of sewing machines.

According to this embodiment, while sewing the opposite edges by a pair of symmetrical right and left sewing machines, the edge, other than the opposite edges of the other cloth, may be sewn by the third sewing machine.

Therefore, automatic sewing of opposite edges and sewing of the edge other than the opposite edges of the other cloth by the operator may be promoted simultaneously, and job effect and job efficiency may be notably enhanced on the whole.

Other features and effects of the invention will be better understood and appreciated from the following detailed description of the preferred embodiment of the invention taken in conjunction with the accompanying drawings.

BRIEF DESCRIPTION OF THE DRAWINGS

FIG. 5 is a partially cut away magnified front view of an auxiliary guide.

FIG. 6 is a front view showing the mechanism of the auxiliary guide.

DETAILED DESCRIPTION OF THE PREFERRED EMBODIMENT

Figure 1:
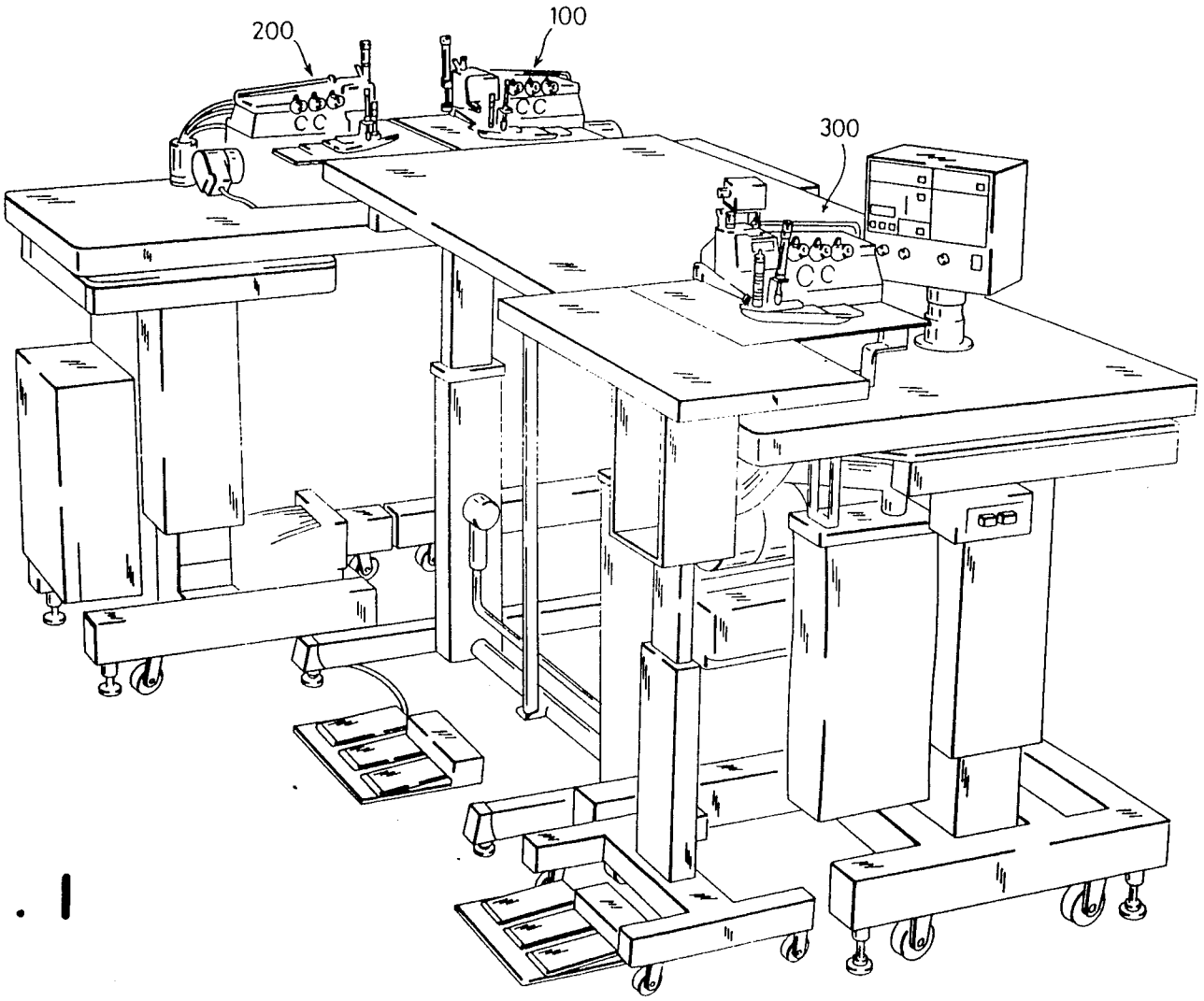
FIG. 1 is a schematic perspective view showing the sewing apparatus of the invention.
Figure 8A:
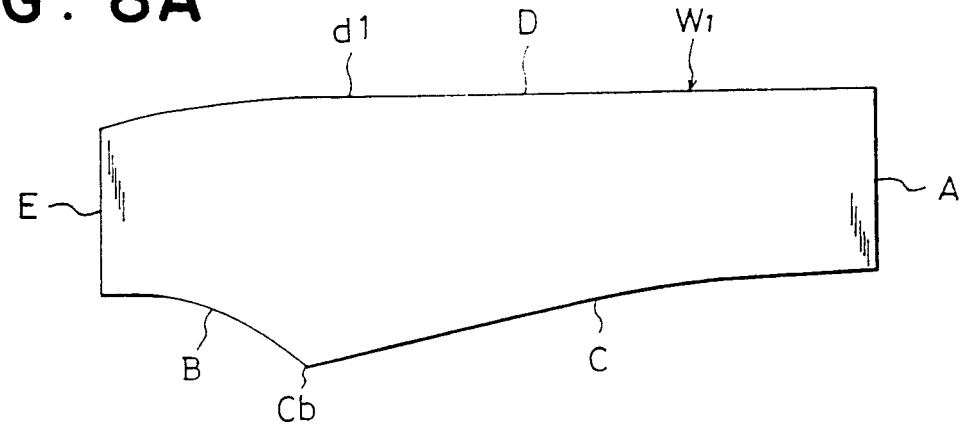
FIG. 8A to FIG. 8C are explanatory diagrams for showing the sewing step of the cloth.

The sewing apparatus shown in FIG. 1 comprises three sewing machines 100, 200, 300. This sewing apparatus is suited to overedge sewing of the peripheral edge of the body cloth W1 of slacks as shown in FIG. 8A.

In FIG. 1, the sewing machines 100, 200 are mirror-symmetrical, mutual needle drop points are opposing, and mutual sewing lines are parallel in the configuration. On the other hand, the sewing machine 300 is disposed, before the symmetrical sewing machines 100, 200, so that its sewing line may be parallel to the sewing lines of the sewing machines 100, 200. This sewing machine 300 may be changed in direction as required. For example, it may be arranged so that its sewing line may be at a right angle to the sewing lines of the sewing machines 100, 200.

Figure 2:
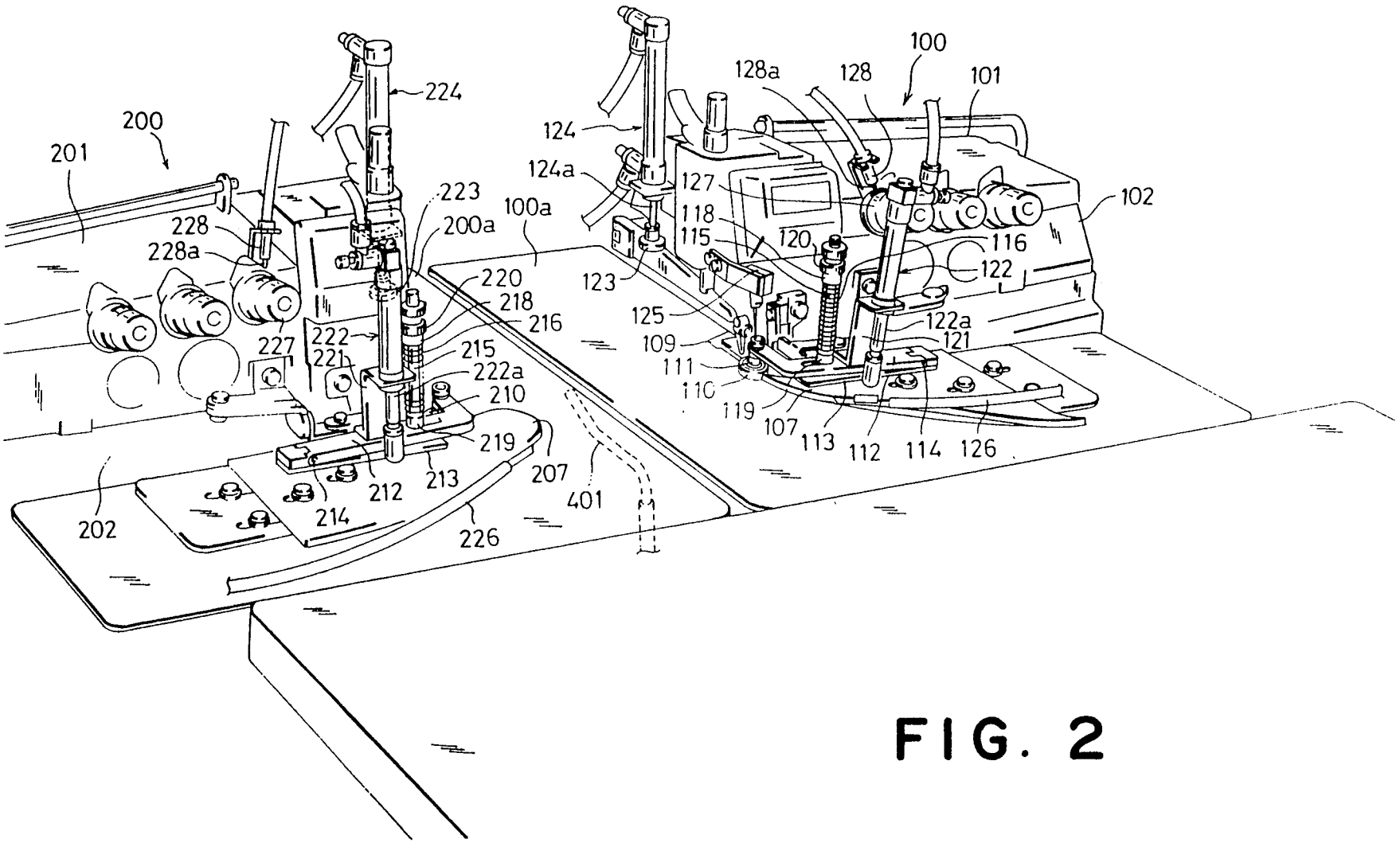
FIG. 2 is a partly magnified perspective view of FIG. 1 showing a pair of opposing sewing machines.
Figure 3:
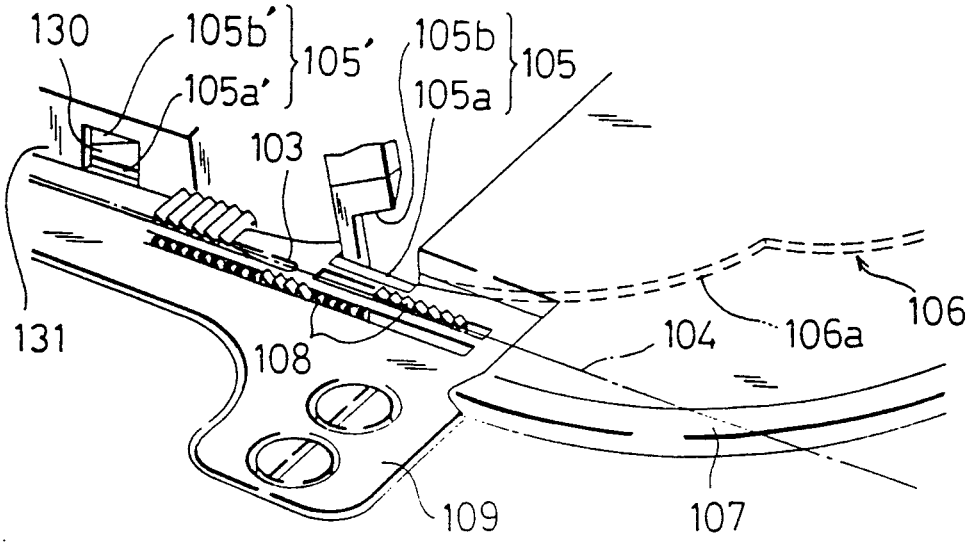
FIG. 3 is a perspective view showing details in the vicinity of the needle drop point.
Figure 4:
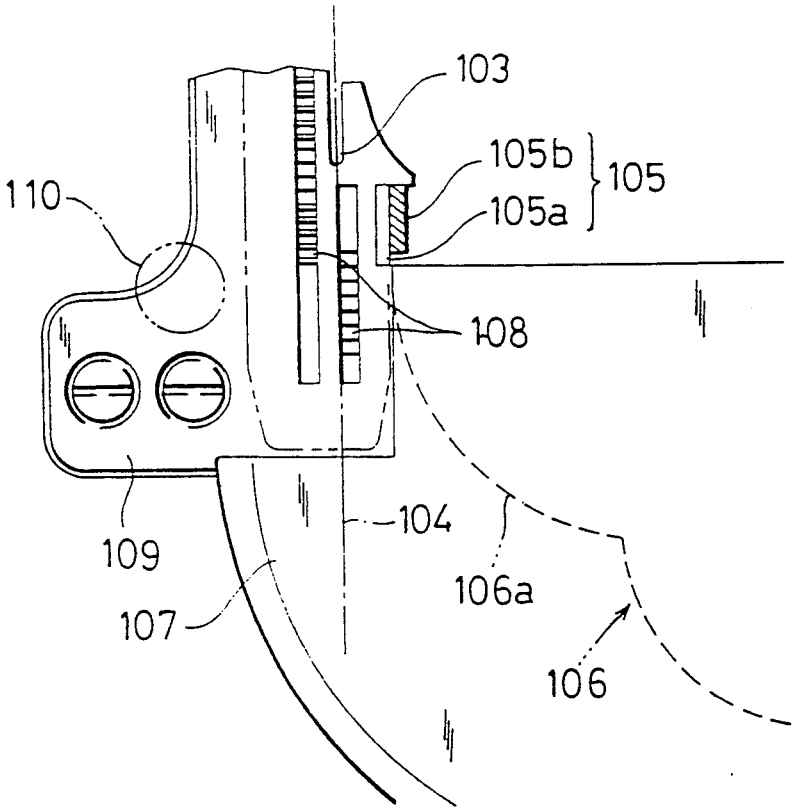
FIG. 4 is a plan view of FIG. 3.

Referring now to FIGS. 2 to 4, the symmetrical sewing machines 100, 200 are explained below. Since the sewing machines 100, 200 are mirror-symmetrical as mentioned earlier, primarily the sewing machine 100 is described below, and the detailed description for the other sewing machine 200 is omitted.

As shown in FIG. 2, the sewing machine 100 is a right sewing machine having an arm 102 of a sewing machine main body 101 disposed at the right side of the needle location. This sewing machine 100 has a cutter 105, as shown in FIGS. 3 and 4, for cutting the cloth edge before the needle drop point 103 and inside of the sewing line 104. This cutter 105 consists of a fixed blade 105*a* and a movable blade 105*b*. The movable blade 105*b* is driven in cooperation with the driving of the sewing machine 100.

As shown in FIGS. 3, 4 and behind the cutter 105, there is disposed a chaining thread cutter 105' consisting of a fixed blade 105*a'* and a movable blade 105*b'*. This chaining thread cutter 105' is also driven in cooperation with the driving of the sewing machine 100. The chaining thread cutter 105' is constructed so as to suck the continuously formed chaining thread to the terminal end of the edge of the cloth between the fixed blade 105*a'* and the movable blade 105*b'* by an air suction force through an opening 130 of a suction device 131, and when the movable blade 105*b'* is driven in this state, the chaining thread is cut off from the cloth.

Before the cutter 105 a plate-shaped guide 106 for guiding the cloth edge is disposed. The guide 106 has a thickness corresponding to the thickness of the cloth to be serged. This guide 106 has an edge 106*a* opposite to the sewing line, and the terminal end of the edge 106*a* nearly matches with the front end of the cutting line of the cutter 105. The edge 106*a* of the guide 106 is formed in a curved shape so as to be remote from the sewing line 104 toward the front side.

On the guide 106, similarly, a plate-shaped cloth guide is overlaid. The cloth guide 107 projects to cross the sewing line 104 from the edge 106*a* before feed dogs 108, and the upper surface of the cloth near the edge of the cloth is guided by the lower surface of this projecting portion.

By the side of the guide 106 and outside of the sewing line 104, an auxiliary guide 110 (omitted in FIG. 3) is disposed on a throat plate 109. The auxiliary guide 110 is, as shown in FIG. 5, composed of a bearing installed at the lower end part of a slant shaft 111 inclined to the sewing machine 100. Therefore, this auxiliary guide 110 rotates along with the feed of the cloth W by causing a part of its peripheral edge to contact with the upper surface of the cloth W on the throat plate 109. For the contact surface of the auxiliary guide 110 to the cloth W, a bearing of small inertia and rotating with a small force is provided at the bottom end of the slant shaft 111 in the embodiment. The surface of the bearing may be also processed by roughening or coated with rubber or plastic depending on the properties of the cloth W.

The slant shaft 111 is supported on the free end of a movable stand 112 as clearly shown in FIG. 6. The base part of the movable stand 112 is pivoted on a support stand 113 oscillatably in the vertical direction through a pin 114. This support stand 113 is fixed on the cloth guide 107.

As shown in FIG. 6, a vertical shaft 115 is fixed on the support stand 113 to penetrate through the movable stand 112. A spring 16 is fitted on the vertical shaft 115 above the movable stand 112, while a spring 117 is fitted beneath the movable stand 112. The upper spring 116 is set outside of the shaft 115 between the movable stand 112 and an adjusting nut 120 fitted to the vertical shaft 115, through spring retainers 118, 119 externally fitted to the vertical shaft 115, thereby biasing the movable stand 112 downward. The spring force of this spring 116 is adjustable by regulating the fitting position of the adjusting nut 120. The lower spring 117 is set outside of the shaft 115 between the movable stand 112 and the support stand 113. This spring 117 has a smaller spring force than the upper spring 116, and supports the movable stand 112 on its lower side.

A mounting piece 121 is set up on the movable stand 112, and an air cylinder 122 is attached to this mounting piece 121. The air cylinder 122 has a piston rod 122*a* facing downward, and the tip end of the piston rod 122*a* is always abutting against the upper surface of the cloth guide 107. Therefore, by extending the piston rod 122*a*, the movable stand 112 rotates about the pin 114, and the auxiliary guide 110 moves up.

The sewing machine 100 has a small disc-shaped cloth stopper 123 behind the needle drop point 103 as shown in FIG. 2. The cloth stopper 123 is mounted on the piston rod 124*a* of an air cylinder 124 above the cloth plate 100*a*. Therefore, by extending the piston rod 124*a*, the cloth stopper 123 locally presses the cloth W on the cloth plate 100*a*.

The air cylinder 124 functions in response to detection by the cloth sensor 125 disposed above the needle drop point 103. Once the cloth sensor 125 has detected the cloth, that is to say, after sewing is started, if the cloth is detected, then, after a specific number of stitches is counted, the piston rod 124*a* is extended. When the piston rod 124*a* is thus extended, a chaining thread is formed to a specified length, continuously to the terminal end of the cloth sewn by the sewing machine 100, then the cloth stopper 123 stops the progress of the cloth at this edge side.

Meanwhile, as shown in FIG. 2, before the cloth guide 107, there is disposed an air hose 126 for blowing out air toward the outer rear side, being supported on the front side of the cloth guide 107. In the middle, between the sewing machines 100 and 200, and beneath the cloth plates 100*a*, 200*a*, there is disposed an air blower 401 for blowing air toward the rear side and obliquely upper side from the gap between the cloth plates 100*a*, 200*a*.

As mentioned above, the sewing machine 200 is mirror-symmetrical to the sewing machine 100 mentioned above. That is, the sewing machine 200 is a left machine having its arm 202 of the sewing machine main body 201 located at the left side of the needle drop point, the left side is inside, and the right side is outside. Therefore, the parts of this sewing machine are identified with the 200 series of numbers, instead of the 100 series used to identify parts of the sewing machine 100 (for example, 201 instead of 101), and a detailed description is omitted.

Figure 7:
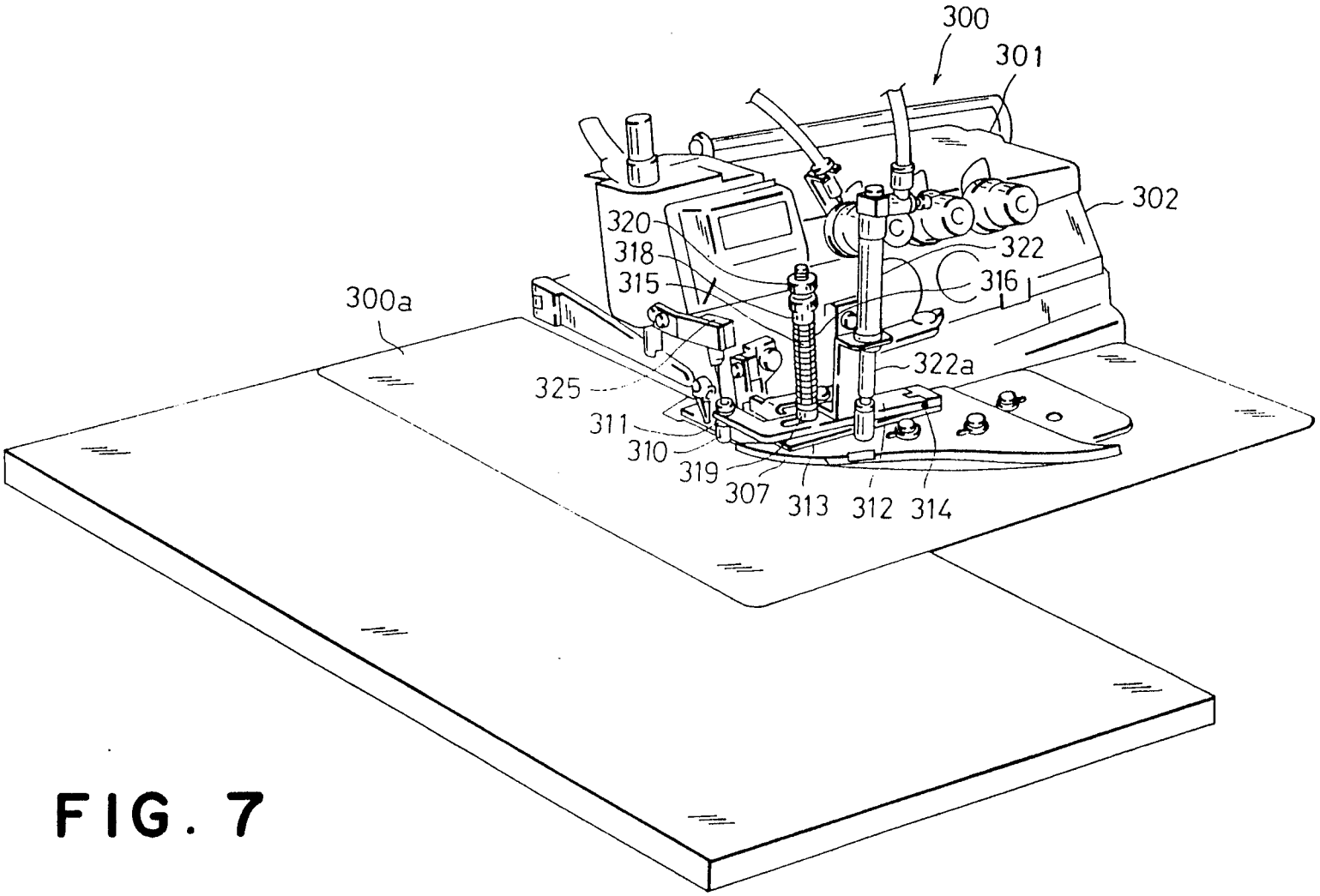
FIG. 7 is a perspective view of the third sewing machine.

Moreover, the sewing machine 300 is, as shown in FIG. 7, nearly the same in construction as the sewing machine 100, and its parts are identified with the 300 series of numbers instead of the 100 series used to identify parts of the sewing machine 100 (for example, 301 instead of 101). However, the sewing machine 300 does not have parts corresponding to the cloth stopper 123 and the air blower 126. Besides, the auxiliary guide 310 is not a rotating element using a bearing, but is formed by the tip end of the slant shaft 311. The position of the auxiliary guide 310 contacting the cloth is behind the cloth guide 307 in the example shown, but, for another example, it may also be designed to penetrate through the notch formed in the cloth guide 307 to contact the cloth beneath the cloth guide 307, and the design may be varied as required. Such a sewing machine 300 is a known right serging machine.

By means of such a constructed sewing apparatus, the edge of the body cloth W1 of the slacks as shown in FIG. 8A may be serged according to the following procedures. As is clear from FIG. 8A, the body W1 has nearly parallel opposite side edges C, D extending from the end portion of the hem edge A. One side edge C is slightly in-curved toward the waist edge E, and is changed to the edge B approaching the other edge D before reaching the waist edge E. The other side edge D is out-curved toward the edge E from the position d1 opposite to the transfer point Cb of the side edge C transferring to the edge B.

Figure 8B:
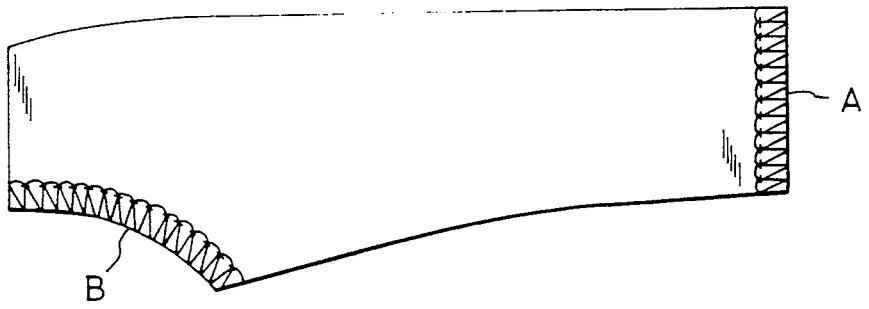
Figure 8C:
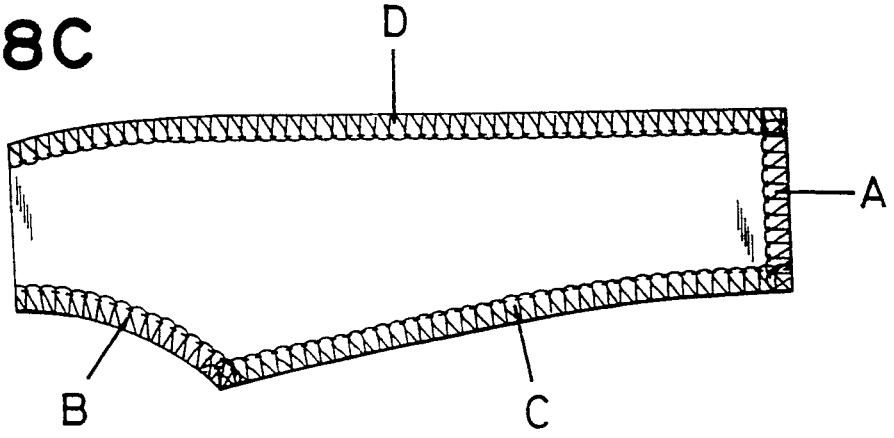

In the first place, by the sewing machine 300 of the sewing apparatus, as shown in FIG. 8B, serging of the hem edge A and edge B of the body cloth W1 is effected as mentioned above. Serging by this serging machine 300 is the same as in the prior art. The operator sets the edges A and B at the sewing positions, and cuts off the chaining thread formed continuously to the edge at the end of every sewing process of edges A, B with a chaining thread cutter such as 105′ shown in FIG. 3.

Figure 9A:
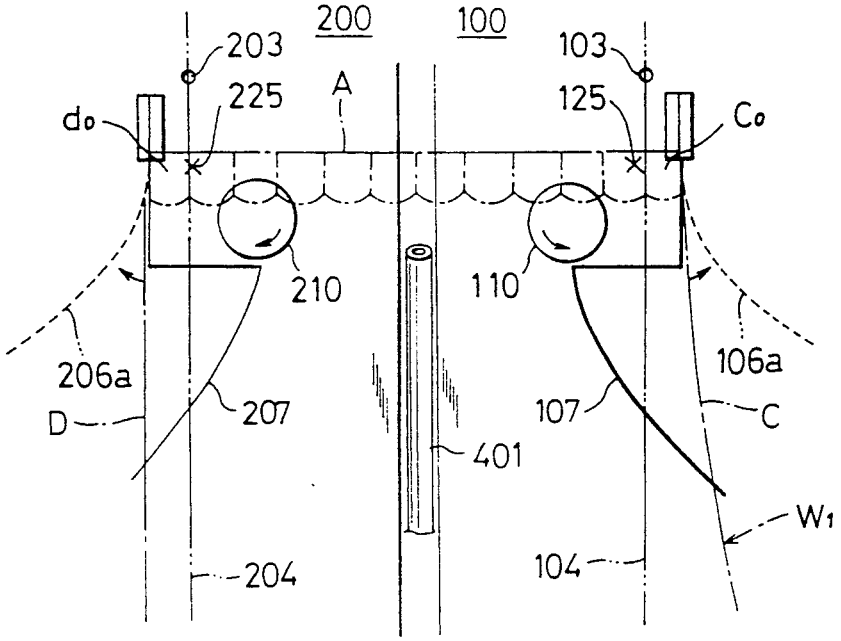
FIG. 9A to FIG. 9C are explanatory diagrams for showing the sewing steps of opposite edges of the cloth.

The side edges C, D of the body cloth W1 after finishing the serging for edges A, B are guided beneath the cloth guides 107, 207 so that the hem edges C0, d0 may be guided into the needle drop points 103, 203 of the sewing machines 100, 200 as shown in FIG. 9A. As is clear from FIG. 9A, the sewing machines 100, 200 are installed so that the interval of the needle drop points 103, 203 may be at least narrower than the gap between the hem edges C0, d0. In this embodiment, moreover, the presser foot (not shown) is kept raised until the body cloth W1 is guided beneath the cloth guides 107, 207, and the piston rods 122*a*, 222*a* of the air cylinders 122, 222 are also extended in this process. As a result, the auxiliary guides 110, 210 may be lifted up together with the presser foot, so that the operator may easily guide the hem edges C0, d0 beneath the cloth guides 107, 207, and move the side edges C, D near the hem edges C0, d0 to abut against the edges 106*a*, 206*a* of the guides 106, 206. In this case, the presser feet and the auxiliary guides 110, 210 may be designed to descend in several seconds after receiving a cloth detection signal from the cloth sensor 125 for sensing the presence of the cloth as the body cloth W1 is set at the specified position. Furthermore, when it is designed to drive the sewing machines 100, 200 simultaneously in several seconds after the presser feet and auxiliary guides 110, 210 descend to touch the body cloth W1, sewing of the side edges C, D will be automatically started only by setting the body cloth W1 at a specified position.

In this way, sewing of the side edges C, D is done simultaneously at the same speed. At this time, in the sewing machines, the auxiliary guides 110, 210 contact the body cloth W1 outside the sewing lines 104, 204, and act to press the body cloth W1 before the contact part inside of the sewing lines 104, 204, respectively. Therefore, while the side edges C, D of the body cloth W1 are being pressed against the guides 106, 206, they are fed in the cloth feed direction without deviation from the needle drop points 103, 203 of the sewing machines 100, 200. Besides, as the sewing progresses, the cloth width between the side edges C, D becomes slightly enlarged and the cloth is loose, but by the air blown out from the air blowers 126, 226, and 401, the loose parts are shifted to the middle side of the body cloth W1, and creases are not formed in the stitch forming area near the side edges C, D.

Figure 9B:
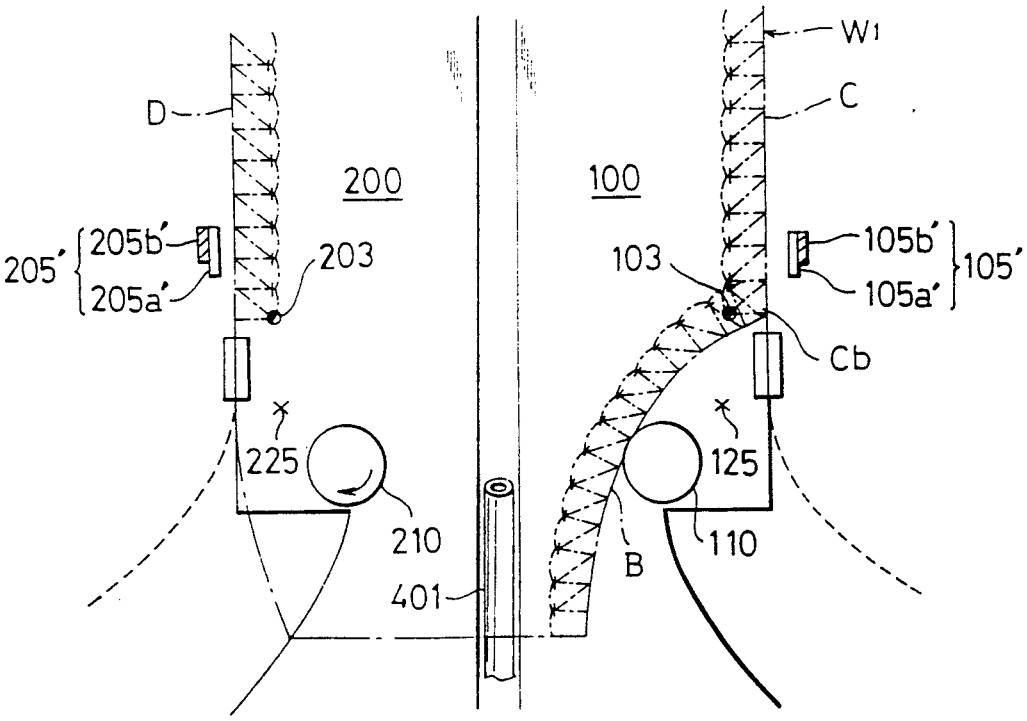
Figure 9C:
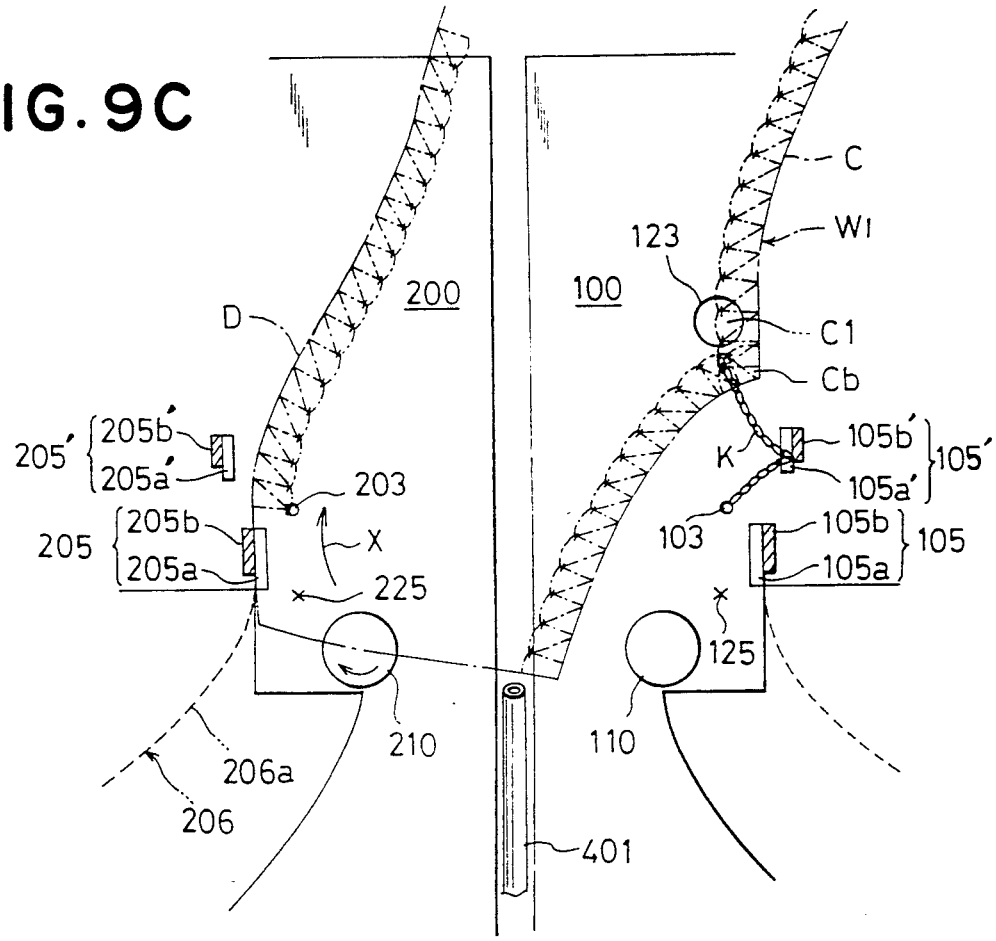

By thus sewing the side edges C, D, as shown in FIG. 9B, the terminal end of the side edge C, that is, the transfer point Cb of the side edge C transferring to the edge B reaches the needle drop point 103 of the sewing machine 100. When the transfer point Cb reaches to the needle drop point 103, the cloth sensor 125 of the sewing machine 100 no longer detects the body cloth W1. As mentioned above, after the cloth sensor 125 fails to detect the body cloth W1, a specified number of stitches is counted, and the air cylinder 124 is actuated to extend the piston rod 124*a*, and the cloth stopper 123 holds down the pressure point C1 near the transfer point Cb of the body cloth W1 behind the needle drop point 103 as shown in FIG. 9C.

As a consequence, the pressure point C1 of the side edge C is held, and progress in the cloth feed direction of this pressure point C1 is arrested, and the body cloth W1 rotates about the pressure point C1 in the direction of the arrow X. Therefore, as shown in FIG. 9C, the out-curve portion of the side edge D is guided toward the needle drop point 203 of the sewing machine 200. Moreover, since the sewing machine 200 is guiding the side edge D toward the needle drop point 203 while pressing against the guide 206 by means of the auxiliary guide 210, sewing of the side edge D continues up to the final stitch without missing.

On the other hand, when a specific number of stitches is counted after the cloth sensor 125 fails to detect the body cloth W1, a chaining thread k continues to a specified length to the transfer point Cb of the side edge C is formed. This chaining thread k is relaxed between the needle drop point 103 and the transfer point Cb as the cloth stopper 123 presses against the pressure point C1, and is hence drawn in between the fixed blade 105*a*' and movable blade 105*b*' of the chaining thread cutter 105'. Since the movable blade 105*b*' cooperates with the sewing machine 100, the drawn in chaining thread is immediately cut off. In this embodiment, meanwhile, the sewing machines 100, 200 have air cylinders 128, 228 disposed with respect to thread regulators 127, 227 (see FIG. 2) for the needle threads for forming the chaining thread k. These air cylinders 128, 228 are provided with pin-shaped piston rods 128*a*, 228*a*, and when forming the chaining thread k, the needle threads are loosed by inserting the piston rods 128*a*, 228*a* between the thread regulator dishes of the thread regulators 127, 227. Thus, the formed chaining thread k is more securely and promptly drawn in between the fixed blade 105*a*' and fixed blade 105*b*'.

Thus, as the cloth stopper 123 presses down the pressure point C1 of the body cloth W1, the out-curve of the side edge D is serged, while the chaining thread formed continuously to the transfer point Cb is cut off from the sewing machine 100.

Thus, when the in-curve of the side edge D is sewn and when serging of the side edge D is over, the cloth sensor 225 of the sewing machine 200 no longer detects the body cloth W1. From this moment of failure of detection of the body cloth W1, when the specific number of stitches of the sewing machine 200 is counted, the air cylinder 224 is actuated, and the cloth stopper 223 of the sewing machine 200 (see FIG. 2) is lowered to press the body cloth W1. Therefore, at this pressure point, the progress of the body cloth W1 is stopped, and the chaining thread (not shown) formed continuously to the terminal end of the side edge D is cut off by the chaining thread cutter 205'.

Figure 10:
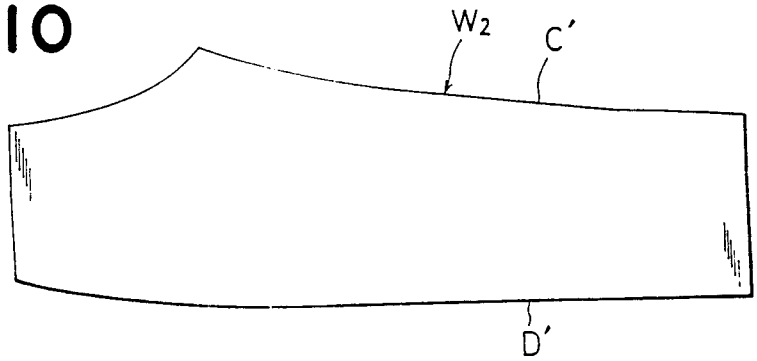
FIG. 10 is a plan view of the other cloth.

This sewing apparatus is also capable of serging the edge similarly even in the case of a body cloth W2 symmetrical to the body cloth W1 in FIG. 8A, as shown in FIG. 10. In this case, when sewing side edges C', D' simultaneously, the operation of the sewing machines 100, 200 is exchanged from the case of the body cloth W2.

As clear from the description herein, according to this sewing apparatus, the side edges C and D of the body cloth W1 can be sewn simultaneously, completely and automatically by the sewing machines 100, 200. Therefore, the operator has only to press the hem edges C0 and d0 to the guides 105, 106 by guiding beneath the cloth guides 107, 207, when serging the side edges C, D, and thereafter can engage with the sewing job for the edges A, B of the next body cloth by the sewing machine 300.

Meanwhile, in the above embodiment, to sew the out-curve at the side edge D on one side of the body cloth, the cloth stopper 123 is lowered by the signal generated when the cloth sensor 125 of the sewing machine 100 sewing the other side edge C no longer detects the cloth, but the timing of lowering this cloth stopper may be properly varied depending on the position of the out-curve. In other words, it is possible to lower the cloth stopper on the basis of another specific signal, such as the signal generated when a specified number of stitches is counted after start of sewing.

What is claimed is:

1. A sewing apparatus comprising a pair of sewing machines positioned symmetrically with respect to a cloth feeding line and disposed opposite to each other, in which each sewing machine comprises:

an auxiliary guide for contacting the upper surface of a cloth before a needle drop point and outside of a sewing line of the sewing machine, an edge guide for guiding the edge of the cloth inside of the sewing line, and a cloth stopper for pressing and stopping the cloth behind the needle drop point when the cloth stopper is actuated by a specific signal which is generated after a terminal end of the cloth to be sewn has passed the needle drop point.

2. The sewing apparatus of claim 1, wherein each of said pair of sewing machines is an overedge sewing machine having a cloth edge cutter and, which continuously forms a chaining thread to the terminal end of the cloth.

3. The sewing apparatus of claim 1, wherein the auxiliary guide is attached on the sewing machine with an elastic member, said auxiliary guide having a slant shaft with a bottom edge which is rotatable around the shaft, to move the edge of the cloth toward the edge guide by turning together with the cloth when the auxiliary guide elastically presses an upper surface of the cloth.

4. The sewing apparatus of claim 2, further comprising: a chaining thread cutter having a fixed blade and a movable blade driven in cooperation with the driving of the overedge sewing machine behind the cloth edge cutter and an opening for inserting the chaining thread between the fixed and movable blade by a suction force of air, wherein the chaining thread cutter draws the chaining thread through the opening and cuts off the chaining thread by the two blades after the cloth stopper has pressed and stopped the cloth in response to the specific signal.

5. The sewing apparatus of claim 2, further comprising: a third overedge sewing machine installed in front of the pair of overedge sewing machines for sewing opposing edges of the cloth, said third overedge sewing machine having an auxiliary guide for contacting with the upper surface of the cloth before the needle drop point and outside of the sewing line of the third overedge sewing machine and an edge guide for guiding other edges of the cloth inside of the sewing line of the third overedge sewing machine.

* * * * *